US009767727B2

(12) United States Patent
Byun et al.

(10) Patent No.: US 9,767,727 B2
(45) Date of Patent: Sep. 19, 2017

(54) DISPLAY PANEL

(71) Applicant: Samsung Display Co., Ltd., Yongin (KR)

(72) Inventors: Min Woo Byun, Jeju-si (KR); Jae Du Noh, Mokpo-si (KR); Seung-Kyu Lee, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 28 days.

(21) Appl. No.: 14/832,602

(22) Filed: Aug. 21, 2015

(65) Prior Publication Data

US 2016/0225312 A1 Aug. 4, 2016

(30) Foreign Application Priority Data

Feb. 2, 2015 (KR) ..... 10-2015-0016356

(51) Int. Cl.
*G09G 3/30* (2006.01)
*G09G 3/3208* (2016.01)
*G09G 3/00* (2006.01)

(52) U.S. Cl.
CPC ..... *G09G 3/3208* (2013.01); *G09G 3/006* (2013.01); *G09G 2300/043* (2013.01); *G09G 2330/045* (2013.01); *G09G 2330/12* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,610,437 | B2 | 12/2013 | Oh | |
| 8,704,762 | B2 | 4/2014 | Anno et al. | |
| 2008/0191213 | A1* | 8/2008 | Bae | H01L 27/124 257/66 |
| 2011/0285610 | A1* | 11/2011 | Yan | G09G 3/20 345/55 |
| 2014/0028650 | A1 | 1/2014 | Bae | |
| 2014/0176844 | A1* | 6/2014 | Yanagisawa | G02F 1/1309 349/43 |
| 2014/0342478 | A1* | 11/2014 | Choi | H01L 29/41733 438/23 |

FOREIGN PATENT DOCUMENTS

| | | |
|---|---|---|
| KR | 10-2011-0017652 | 2/2011 |
| KR | 10-2011-0132532 | 12/2011 |
| KR | 10-2013-0136806 | 12/2013 |
| KR | 10-2014-0015887 | 2/2014 |

* cited by examiner

*Primary Examiner* — Jennifer Mehmood
*Assistant Examiner* — Sosina Abebe
(74) *Attorney, Agent, or Firm* — H.C. Park & Associates, PLC

(57) ABSTRACT

A display panel including: pixels disposed in an active area of a substrate; data lines connected to the pixels; and a crack detection line disposed in a peripheral area of the active area in the substrate. The crack detection line includes a plurality of stacked conductive layers and at least one insulating layer disposed therebetween. At least one of the conductive layers is electrically connected to any one of the data lines.

10 Claims, 11 Drawing Sheets

DISPLAY PANEL

CROSS-REFERENCE TO RELATED APPLICATION

This application claims priority from and the benefit of Korean Patent Application No. 10-2015-0016356, filed on Feb. 2, 2015, which is hereby incorporated by reference for all purposes as if fully set forth herein.

BACKGROUND

Field

Exemplary embodiments relate to a flat panel display panel.

Discussion of the Background

Recently, with the development of semiconductor manufacturing technologies and image processing technologies, weight reduction and thinness of a display device may be easily achieved. Flat panel display devices, which may realize high image quality, have been commercialized and rapidly propagated.

A liquid crystal display (LCD), a field emission display (FED), a plasma display panel (PDP), and an organic light emitting diode display (OLED) are several popular examples of a flat panel display device.

Among these flat panel display devices, the weight reduction, thinness, and high image quality of the LCD and the OLED, and the like may be easily achieved. Therefore, the LCD and the OLED may be widely adopted in portable devices, for example, a mobile phone, a PDA, a portable computer, and the like.

In particular, an OLED, which is a self-emission device, does not require a backlight like an LCD. Therefore, an OLED may be manufactured to be much thinner and have a response speed on the order of tens of nanoseconds, a wide viewing angle, and good contrast. As a result, the OLED has drawn much attention as a next generation display.

However, as the display panel of the flat panel display evolves to be large, light, and thin, the display panel needs to have good durability against cracking, scratches, and breakage phenomena resulting from an external impact.

As a crack, etc., occur in the display panel, in particular, as a power supply applied to the display panel may be short-circuited, and thus, an overcurrent flows in the panel, a temperature rises and thus the display panel catch fire. Further, a DC-DC converter is in an overload condition due to the occurring short, which leads to a destruction of the DC-DC converter and its various peripheral circuits, such as an inductor.

Therefore, even though the display panel is partially damaged, processing to minimize the damage of the display panel is required so as to safely protect the display panel from overheating and the possibility of fire.

In particular, the power supply applied to the display panel may be shorted or opened as a result of the occurrence of cracks, and the like, in the display panel of the organic light emitting diode display. As a result, there is a need to rapidly solve the problem in that a screen is abnormally displayed or driving power is not supplied properly.

When errors occur in the display panel, it is difficult for a user to determine the errors in the early stage, and when the user confirms the errors with the naked eyes, the failure of the display device is likely to be considerably aggravated.

When the errors occur, since the image quality may be changed, a fire may break out due to the overheating, or an end user may be burned, there is a need to detect the errors of the display panel in the early stage.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display panel capable of detecting damage to the display panel as a result of cracks and other defects.

Additional aspects will be set forth in the detailed description which follows, and, in part, will be apparent from the disclosure, or may be learned by practice of the inventive concept.

An exemplary embodiment of the present disclosure discloses a display panel including: pixels disposed in an active area of a substrate; data lines connected to the pixels; and a crack detection line disposed in a peripheral area of the active area in the substrate. The crack detection line includes a plurality of stacked conductive layers and at least one insulating layer disposed therebetween. At least one of the conductive layers is electrically connected to any one of the data lines.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
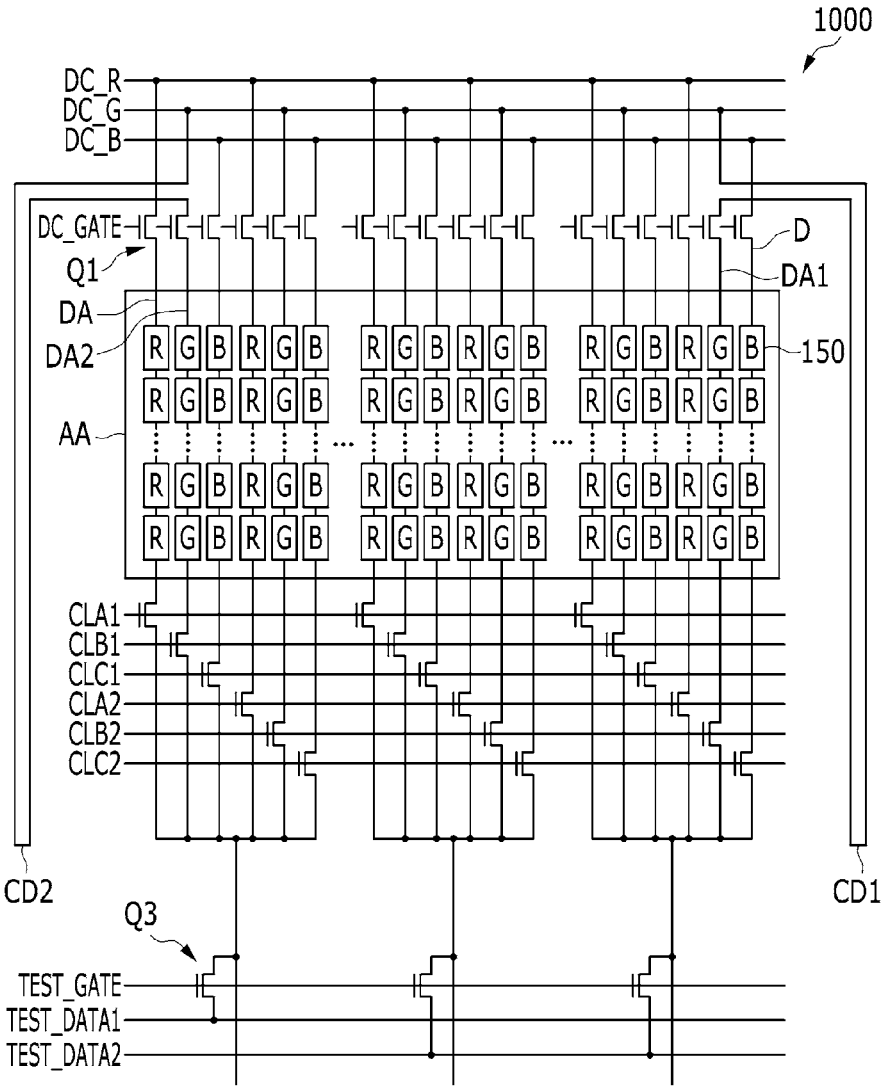
FIG. 1 is a schematic layout view of a display panel according to an exemplary embodiment of the present disclosure.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

First, a display panel according to exemplary embodiments of the present disclosure will be described with reference to FIG. 1.

FIG. 1 is a schematic layout view of a display panel according to an exemplary embodiment of the present disclosure.

Referring to FIG. 1, a display panel 1000 includes pixels 150 formed on a substrate and signal lines connected thereto. The pixels 150 are formed in an active area AA of the substrate and at least some of the signal lines are formed in a peripheral area of the substrate.

The signal lines include a plurality of first test signal lines DC_R, DC_G, and DC_B, a plurality of second test signal lines TEST_DATA1 and TEST_DATA2, a first test control signal line DC_GATE, a second test control signal line TEST_GATE, a plurality of data control signal lines CLA1, CLA2, CLB1, CLB2, CLC1, and CLC2, a plurality of data lines DAs, and a plurality of crack detection lines CD1 and CD2.

The first test signal lines DC_R, DC_G, and DC_B, the first test control signal line DC_GATE, and the data lines DA are connected to a plurality of first switching elements Q1.

The data control signal lines CLA1, CLA2, CLB1, CLB2, CLC1, and CLC2 and the data lines DAs are connected to a plurality of second switching elements Q2.

The second test signal lines TEST_DATA1 and TEST_DATA2, the second test control signal line TEST_GATE, and the data lines DAs are connected to a plurality of third switching elements Q3.

The first and second crack detection lines CD1 and CD2 are signal lines for detecting damage due to a crack in the peripheral area enclosing the active area of the display panel 1000.

The first and second crack detection lines CD1 and CD2 are formed to extend toward different outside areas of the display panel 1000. For example, the first crack detection line CD1 and the second crack detection line CD2 are each disposed in the outside areas of both sides of the active area AA.

The first and second crack detection lines CD1 and CD2 each have a mufti-layered wiring structure in which a plurality of conductive layers (not illustrated) are stacked.

At least one of the conductive layers configuring the first crack detection line CD1 is connected between the first test signal line DC_G and a data line DA1. At least one of the conductive layers configuring the first crack detection line CD1 is connected to a signal line (e.g., ELVSS line) through which a signal having a predetermined voltage level is supplied.

At least one of the conductive layers configuring the second crack detection line CD2 is connected between the first test signal line DC_G and a data line DA2. At least one of the conductive layers configuring the second crack detection line CD2 is connected to a signal line (e.g., ELVSS line) through which a signal having a predetermined voltage level is supplied.

A detection signal for crack detection needs to be supplied to the corresponding data lines DAs through the crack detection lines CD1 and CD2 during the crack detection test. However, there is a need to cut off an electrical connection between the crack detection lines CD1 and CD2 and each data line DA whenever the crack detection test is not in progress. Therefore, the first crack detection line CD1 is connected to the data line DA1 through the switching element Q1.

That is, at least one of the conductive layers configuring each crack detection line CD1 and CD2 has one end electrically connected to the first test signal line DC_G and the other end connected to a drain electrode (or source electrode) of the first switching element Q1. Therefore, at least one of the conductive layers configuring each crack detection line CD1 and CD2 which is connected between the first test signal line DC_G and each data line DA1 and DA2 is electrically connected to the data lines DA1 and DA2 through the first switching element Q1.

The multi-layered wiring structure of the crack detection lines CD1 and CD2 will be described in detail with reference to FIGS. 5 to 10, as described below.

Hereinafter, a crack detection operation in the display panel according to the exemplary embodiments of the present disclosure will be described with reference to FIGS. 2A and 2B.

Figure 2A:
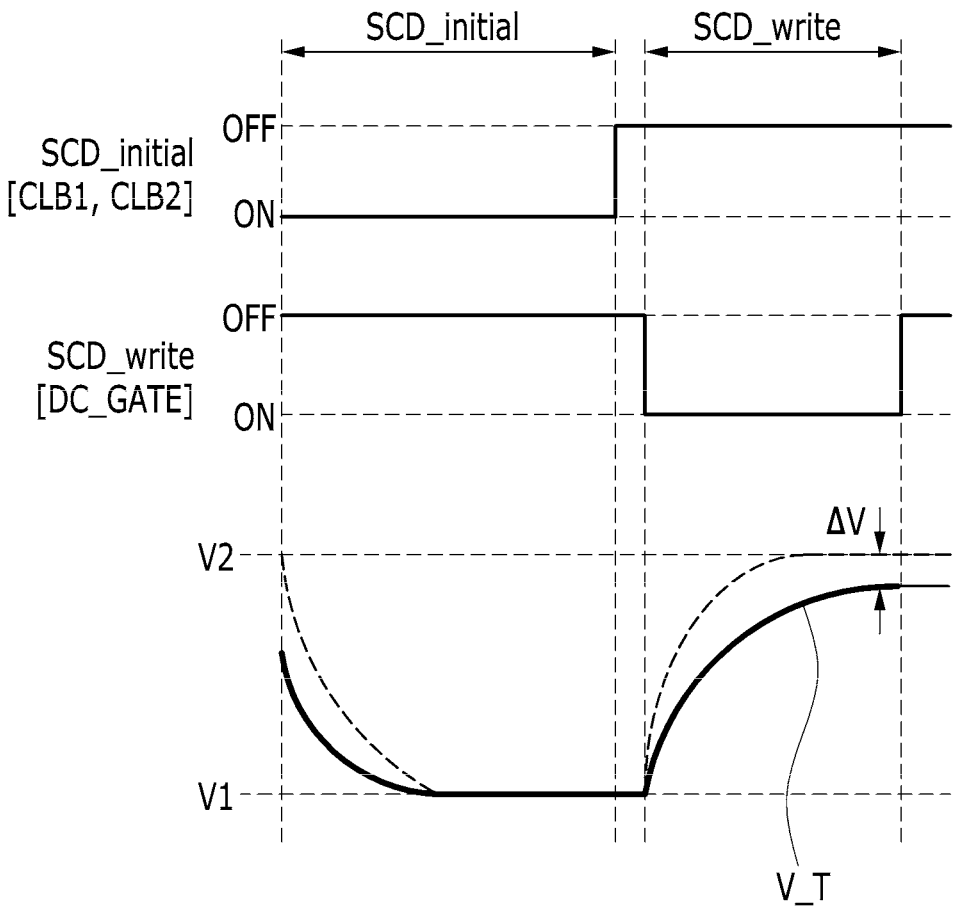
FIG. 2A is a diagram for describing a crack detection operation in a display panel according to an exemplary embodiment of the present disclosure.
Figure 2B:
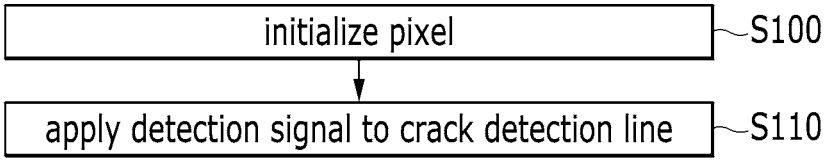
FIG. 2B is a flow chart illustrating a crack detection method in a display panel according to an exemplary embodiment of the present disclosure.

Referring to FIGS. 2A and 2B, an initialization control signal SCD_initial for initializing the plurality of pixels 150 is applied to the data control signal lines CLB1 and CLB2. Further, a detection control signal SCD_write for applying a detection signal V2 to the pixels 150 is applied to the first test control signal line DC_GATE.

The pixels 150 are initialized to display a white color prior to applying the detection signal V1 to the crack detection lines CD1 and CD2 (S100).

In step S100, to initialize the pixels 150, the initialization control signal SCD_initial is in an "on" state. Therefore, the second switching elements Q2, which are controlled by the data control signal lines CLB1 and CLB2, are in an "on" state. Further, an "on" signal is applied to the second test control signal line TEST_GATE, and thus, the third switching element Q3 is in an "on" state. Therefore, the initialization signal V1 applied to the second test signal lines TEST_DATA1 and TEST_DATA2 is applied to each data line DA. The initialization signal V1 is a signal for initializing the pixels 150 at a predetermined level and is a signal for allowing the pixels 150 to display a white color. The pixels 150 display a white color by applying the initialization signal V1 to the data lines DAs.

An "off" signal is applied to the first test control signal line DC_GATE for a period H1 in which the pixels 150 are initialized, and thus, the first switching elements Q1 are in an "off" state.

When the initialization period H1 ends, the initialization control signal SCD_initial is in an "off" state, and thus, the second switching elements Q2 controlled by the data control signal lines CLB1 and CLB2 are in an "off" state.

When the initialization for the pixels 150 ends, the detection signal V2 having a predetermined level is applied to the data lines DAs to allow the pixels 150 to display a black color (S110).

In step S110, to apply the detection signal V2 to each data line DA, the detection control signal SCD_write is in an "on" state. Therefore, the first switching elements Q1 controlled by the first test control signal line DC_GATE are in an "on" state and the detection signal V2 applied to the first test signal lines DC_R, DC_G, and DC_B is applied to the data lines DAs through the first switching elements Q1. Further, the detection signal V2 applied to the first test signal lines DC_R, DC_G, and DC_B is applied to DA1 and DA2 of the plurality of data lines DAs through the corresponding crack detection lines CD1 and CD2 and the first switching element Q1. The detection signal V2 is a signal for charging the pixels 150 at a predetermined level and is a signal for allowing the pixels 150 to display a black color. The pixels 150 display a black color by applying the detection signal V2 to the data lines DAs.

When a crack appears in the insulating layer in the peripheral area of the display panel 1000 and includes foreign particles, at least one of the conductive layers configuring the crack detection lines CD1 and CD2, which is connected between the first test signal line DC_G and the data lines DA1 and DA2, may be shorted from other conductive layers.

Therefore, the detection signal V2 flowing from the first test signal line DC_G toward the crack detection lines CD1 and CD2 is supplied to the first data line DA1 or the second data line DA2, while being distorted. Therefore, a voltage V_T applied to the pixel 150 connected to the first data line DA1 or the second data line DA2 is not charged up to the voltage level of the detection signal V2, and therefore, a voltage difference ΔV from the detection signal V2 is generated.

The voltage difference ΔV is generated such that the pixel 150 connected to the first data line DA1 and the second data line DA2 does not display a black color and is displayed brightly. As such, a crack occurring in the peripheral area of the active area AA is sensed by the brightly displayed pixel 150

Meanwhile, FIG. 2A illustrates, for example, the case in which the initialization signal V1 is applied to the second test data signal lines TEST_DATA1 and TEST_DATA2, but the exemplary embodiment of the present disclosure is not limited thereto. In some of the exemplary embodiments of the present disclosure, the initialization signal V1 may be applied to the first test data signal lines DC_R, DC_G, and DC_B. In this case, the initialization control signal SCD_initial for initializing the pixels 150 is applied to the first test control signal line DC_GATE.

Further, FIG. 2A illustrates, for example, the case in which the detection signal V2 is applied to the plurality of first test data signal lines DC_R, DC_G, and DC_B, but the exemplary embodiment of the present disclosure is not limited thereto. In some of the exemplary embodiments of the present disclosure, the detection signal V2 may be applied to the plurality of second test data signal lines TEST_DATA1 and TEST_DATA2. In this case, the detection control signal SCD_write for applying the detection signal to the plurality of pixels 150 may be applied to the second test control signal lines TEST_GATE or the data control signal lines CLB1 and CLB2.

Hereinafter, prior to describing the multi-layered wiring structure of the crack detection lines CD1 and CD2, the pixel 150 of the display panel 1000 according to the exemplary embodiments of the present disclosure will be described in more detail.

Figure 3:
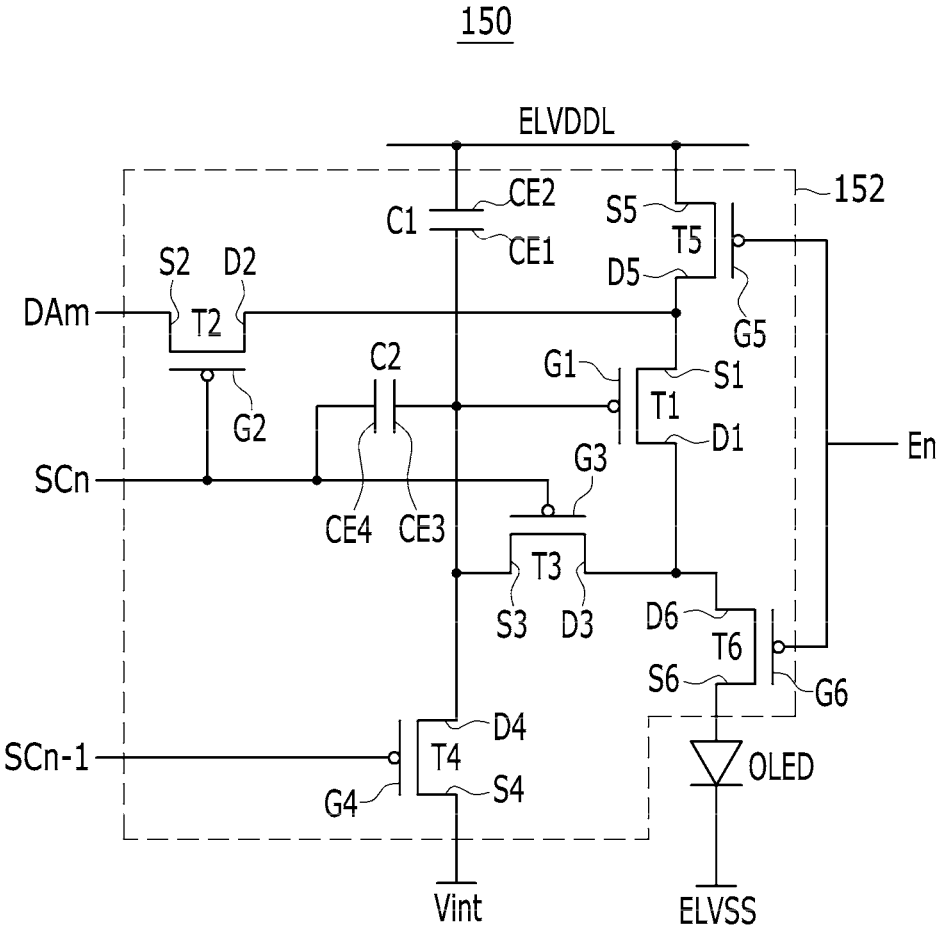
FIG. 3 is an equivalent circuit diagram of one pixel configuring the display panel.
Figure 4:
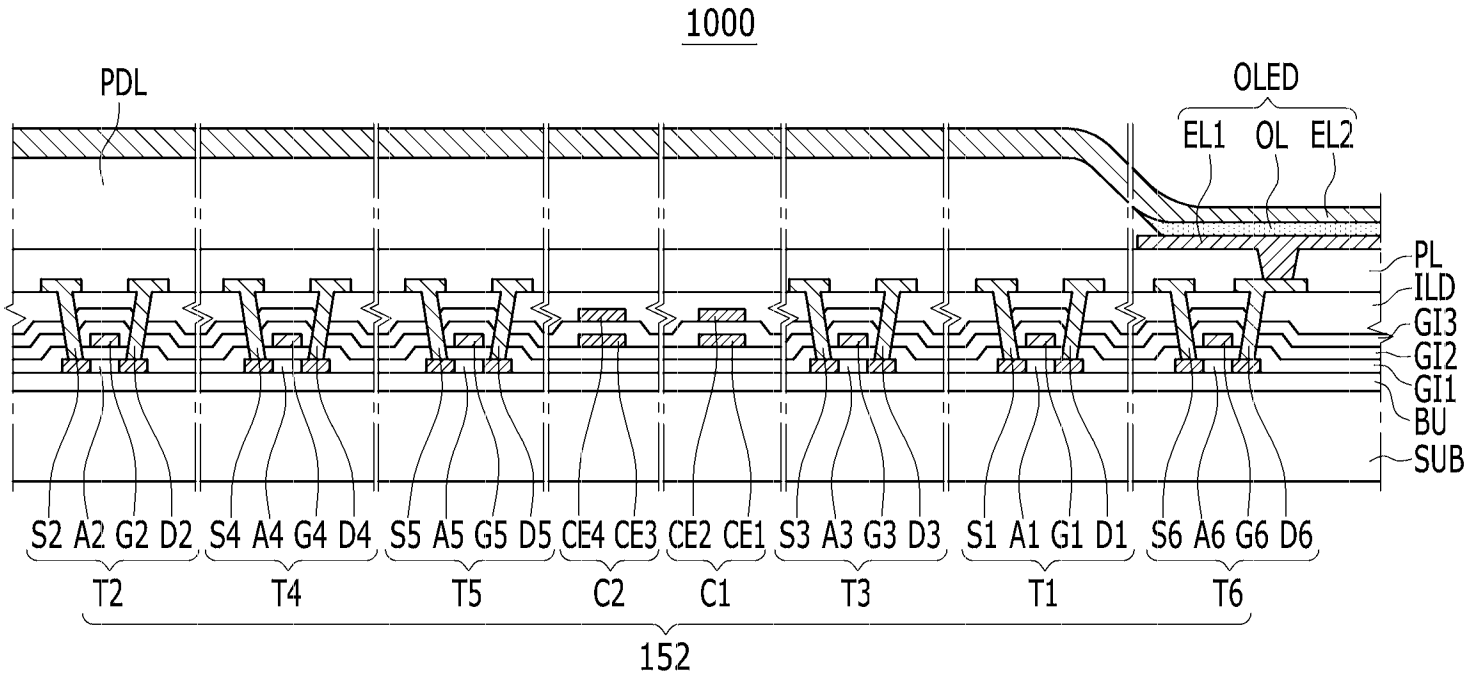
FIG. 4 is a cross-sectional view illustrating a pixel circuit and an organic light emitting diode of FIG. 3.

FIG. 3 is a circuit diagram illustrating the pixel illustrated in FIG. 1. FIG. 4 is a cross-sectional view illustrating the pixel circuit and the organic light emitting diode illustrated in FIG. 3.

As illustrated in FIGS. 3 and 4, the pixel 150 includes the organic light emitting diode (OLED) which is connected between a first power supply ELVDD and a second power supply ELVSS and a pixel circuit 152 which is connected between the first power supply ELVDD and the organic light emitting diode (OLED) to control the driving power supplied to the organic light emitting diode (OLED).

An anode of the organic light emitting diode (OLED) is connected to a driving power line ELVDDL connected to the first power supply ELVDD through the pixel circuit 152 and a cathode of the organic light emitting diode (OLED) is connected to the second power supply ELVSS. The organic light emitting diode (OLED) is supplied with the driving power from the first power supply ELVDD through the pixel circuit 152 and emits light at luminance corresponding to a driving current flowing in the organic light emitting diode (OLED) when common power is supplied from the second power supply ELVSS.

The pixel circuit 152 includes a first thin film transistor T1, a second thin film transistor T2, a third thin film transistor T3, a fourth thin film transistor T4, a fifth thin film transistor T5, a sixth thin film transistor T6, a first capacitor C1, and a second capacitor C2.

The first thin film transistor T1 is connected between the driving power line ELVDDL and the organic light emitting diode (OLED) and supplies the driving power corresponding to the data signal from the first power supply ELVDD to the organic light emitting diode (OLED) for an emission period of the pixel 150. That is, the first thin film transistor T1 serves as a driving transistor of the pixel 150. The first thin film transistor T1 includes a first active layer A1, a first gate electrode G1, a first source electrode S1, and a first drain electrode D1.

The first active layer A1 is positioned between a buffer layer BU formed on a substrate SUB and a first insulating layer GI1. When the first active layer A1 is turned on by the first gate electrode G1, the first active layer A1 connects between the driving power line ELVDDL among the signal lines DAs and the organic light emitting diode (OLED).

The first gate electrode G1 is connected to a first capacitor electrode CE1 of the first capacitor C1 and is positioned on the same layer as the first capacitor electrode CE1. The first gate electrode G1 is positioned on a channel region of the first active layer A1, having the first insulating layer Gl1 and a second insulating layer G12, which are sequentially stacked on the first active layer A1, disposed therebetween. That is, the first insulating layer GI1 and the second insulating layer GI2 are positioned between the first gate electrode G1 and the first active layer A1.

A first source electrode S1 is connected to the driving power line ELVDDL through a fifth thin film transistor T5.

The first drain electrode D1 is connected to the organic light emitting diode (OLED) through the sixth thin film transistor T6.

The second thin film transistor T2 is connected between a data line DAm and the first thin film transistor T1, and when a scan signal is supplied from a first scan line SCn, the data signal supplied from the data line DAm is transferred into the pixel 150. That is, the second thin film transistor T2 serves as a switching transistor of the pixel 150. The second thin film transistor T2 includes a second active layer A2, a second gate electrode G2, a second source electrode S2, and a second drain electrode D2.

The second active layer A2 is positioned between the buffer layer BU formed on the substrate SUB and the first insulating layer GI1. When the second active layer A2 is turned on by the second gate electrode G2, the second active layer A2 connects between the data line DAm among the signal lines and the first thin film transistor T1.

The second gate electrode G2 is connected to the first scan line SCn and is positioned on the channel region of the second active layer A2, having the first insulating layer GI1 disposed therebetween. That is, the first insulating layer Gl1 is positioned between the second gate electrode G2 and the second active layer A2.

A second source electrode S2 is connected to the data line DAm.

The second drain electrode D2 is connected to the first source electrode S1 of the first thin film transistor T1.

The third thin film transistor T3 is connected between the first drain electrode D1 and the first gate electrode G1 of the first thin film transistor T1, and when the data signal is supplied to the pixel 150, connects the first thin film transistor T1 in a diode form to compensate for a threshold voltage of the first thin film transistor T1. That is, the third thin film transistor T3 serves as a compensation transistor of the pixel 150. The third thin film transistor T3 includes a third active layer A3, a third gate electrode G3, a third source electrode S3, and a third drain electrode D3.

The third active layer A3 is positioned between the buffer layer BU formed on the substrate SUB and the first insulating layer GI1.

The third gate electrode G3 is connected to the first scan line SCn and is positioned on the same layer as the second gate electrode G2. That is, the first insulating layer Gl1 is positioned between the third gate electrode G3 and the third active layer A3.

The third source electrode S3 is connected to the first gate electrode G1 of the first thin film transistor T1.

The third drain electrode D3 is connected to the first drain electrode D1 of the first thin film transistor T1.

The fourth thin film transistor T4 is connected between an initialization power line Vinit and the first gate electrode G1 of the first thin film transistor T1 and transfers the initialization power supplied from the initialization power line Vinit into the pixel 150 when the scan signal is supplied from a second scan line SCn−1 for an initialization period earlier than a data programming period to initialize the first thin film transistor T1 so that the data signal may be smoothly supplied into the pixel 150 for the data programming period for which the data signal is input to the pixel 150. That is, the fourth thin film transistor T4 serves as the switching transistor of the pixel 150. The fourth thin film transistor T4 includes a fourth active layer A4, a fourth gate electrode G4, a fourth source electrode S4, and a fourth drain electrode D4.

The fourth active layer A4 is positioned between the buffer layer BU formed on the substrate SUB and the first insulating layer GI1.

The fourth gate electrode G4 is connected to the second scan line SCn−1 and is positioned on the same layer as the second gate electrode G2. That is, the first insulating layer Gl1 is positioned between the fourth gate electrode G4 and the fourth active layer A4.

A fourth source electrode S4 is connected to the initialization power line Vinit.

The fourth drain electrode D4 is connected to the first gate electrode G1 of the first thin film transistor T1.

The fifth thin film transistor T5 is connected between the driving power line ELVDDL and the first thin film transistor T1, cuts off the connection between the first power supply ELVDD and the first thin film transistor T1 for a non-emission period of the pixel 150, and connects the first power supply ELVDD and the first thin film transistor T1 for the emission period of the pixel 150. That is, the fifth thin film transistor T5 serves as the switching transistor of the pixel 150. The fifth thin film transistor T5 includes a fifth active layer A5, a fifth gate electrode G5, a fifth source electrode S5, and a fifth drain electrode D5.

The fifth active layer A5 is positioned between the buffer layer BU formed on the substrate SUB and the first insulating layer GI1.

The fifth gate electrode G5 is connected to an emission control line En and is positioned on the same layer as the second gate electrode G2. That is, the fifth insulating layer Gl1 is positioned between the fifth gate electrode G5 and the fifth active layer A5.

The fifth source electrode S5 is connected to the driving power line ELVDDL.

The fifth drain electrode D5 is connected to the first source electrode S1 of the first thin film transistor T1.

The sixth thin film transistor T6 is connected between the first thin film transistor T1 and the organic light emitting diode (OLED), cuts off the connection between the first thin film transistor T1 and the organic light emitting diode (OLED) for the non-emission period of the pixel 150, and connects between the first thin film transistor T1 and the organic light emitting diode (OLED) for the emission period of the pixel 150. That is, the sixth thin film transistor T6 serves as the switching transistor of the pixel 150. The sixth thin film transistor T6 includes a sixth active layer A6, a sixth gate electrode G6, a sixth source electrode S6, and a sixth drain electrode D6.

The sixth active layer A6 is positioned between the buffer layer BU formed on the substrate SUB and the first insulating layer GI1.

The sixth gate electrode G6 is connected to the emission control line En and is positioned on the same layer as the second gate electrode G2. That is, the first insulating layer Gl1 is positioned between the sixth gate electrode G6 and the sixth active layer A6.

The sixth source electrode S6 is connected to the first drain electrode D1 of the first thin film transistor T1.

The sixth drain electrode D6 is connected to the anode of the organic light emitting diode (OLED).

Each of the first source electrode S1 to the sixth source electrode S6, and each of the first drain electrode D1 to sixth drain electrode D6, of the first thin film transistor T1 to sixth thin film transistor T6, respectively, of the display panel 1000 according to the exemplary embodiments of the present disclosure are formed on a layer different from the first active layer A1 to the sixth active layer A6, respectively, to penetrate through the first insulating layer GI1, the second insulating layer GI2, the third insulating layer GI3, and the fourth insulating layer ILD so as to be connected to the first active layer A1 to the sixth active layer A6, respectively. However, the exemplary embodiments of the present disclosure are not limited thereto, and each of the first source electrode to the sixth source electrode, and each of the first drain electrode to the sixth drain electrode, of the first thin film transistor to the sixth thin film transistor, respectively, of the organic light emitting diode display may be selectively formed on the same layer as the first active layer to the sixth active layer, respectively.

The first capacitor C1 stores the data signal supplied into the pixel 150 for the data programming period and maintains the stored data signal for one frame, and is connected between the driving power line ELVDDL connected to the first power supply ELVDD and the first gate electrode G1 of the first thin film transistor T1 connected to the initialization power line Vinit. That is, the first capacitor C1 serves as a storage capacitor. The first capacitor C1 includes a first capacitor electrode CE1 and a second capacitor electrode CE2.

The first capacitor electrode CE1 is connected to the first gate electrode G1 of the first thin film transistor T1 connected to the initialization power line Vinit, and is positioned on the same layer as the first gate electrode G1.

The second capacitor electrode CE2 is connected to the driving power line ELVDDL and is positioned on the first capacitor electrode CE1, having the third insulating layer G13 stacked on the first gate electrode G1 disposed therebetween. That is, the third insulating layer G13 is positioned between the second capacitor electrode CE2 and the first capacitor electrode CE1. As illustrated in FIG. 1, the second capacitor electrode CE2 transverses the adjacent pixel 150, and thus, may extend in a first direction.

The second capacitor C2 compensates for a voltage drop due to a load in the display panel 1000, and is connected between the first capacitor electrode CE1 of the first capacitor C1 and the first scan line SCn among gate wires GW. That is, the second capacitor C2 increases a voltage of the first gate electrode G1 of the first thin film transistor T1 by a coupling action when the voltage level of the current scan signal is changed, in particular, when the supply of the current scan signal stops, and thus serves as a boosting capacitor compensating for the voltage drop due to the load in the display panel 1000. The second capacitor C2 includes a third capacitor electrode CE3 and a fourth capacitor electrode CE4.

The third capacitor electrode CE3 is connected to a first capacitor electrode CE1 of the first capacitor C1 and is positioned on the same layer as the first gate electrode G1.

The fourth capacitor electrode CE4 is connected to the first scan line SCn among the gate wires GW and is positioned on the third capacitor electrode CE3, having the third insulating layer G13 stacked on the first gate electrode G1 disposed therebetween. That is, the third insulating layer G13 is positioned between the fourth capacitor electrode CE4 and the third capacitor electrode CE3.

As described above, the sixth drain electrode D6 of the sixth thin film transistor T6 of the pixel circuit 152 is connected to the organic light emitting diode (OLED).

The organic light emitting diode (OLED) includes an anode EL1 which is positioned on the sixth drain electrode D6, having a fifth insulating layer PL disposed therebetween to be connected to the sixth drain electrode D6, an organic emission layer OL, and a cathode EL2 connected to the second power supply ELVSS. A position of the organic emission layer OL may be determined by a pixel defined layer (PDL) and the cathode EL2 may be positioned over the whole of the pixel defined layer (PDL).

In the display panel 1000 having the foregoing structure, the first gate electrode G1 and the second gate electrode G2 are disposed on different layers, having the second insulating layer GI2 disposed therebetween.

The pixel circuit 152 of the display panel 1000 according to the exemplary embodiment of the present disclosure has a structure of six transistors and two capacitors. However, the exemplary embodiment of the present disclosure is not limited thereto, and the number of transistors and the number of capacitors may be different from the illustrated exemplary embodiment.

Hereinafter, the multi-layered wiring structure of the crack detection line according to the exemplary embodiments of the present disclosure will be described with reference to FIGS. 5 to 10. FIGS. 5 to 10 are cross-sectional views schematically illustrating the crack detection line in a display panel according to the exemplary embodiment of the present disclosure.

Hereinafter, the multi-layered wiring structure of the first crack detection line CD1 in the display panel 1000 of FIG. 1 will be described. The second crack detection line CD2 has the multi-layered wiring structure having the same structure as the first crack detection line CD1, and therefore, the description thereof will be omitted.

Figure 5:
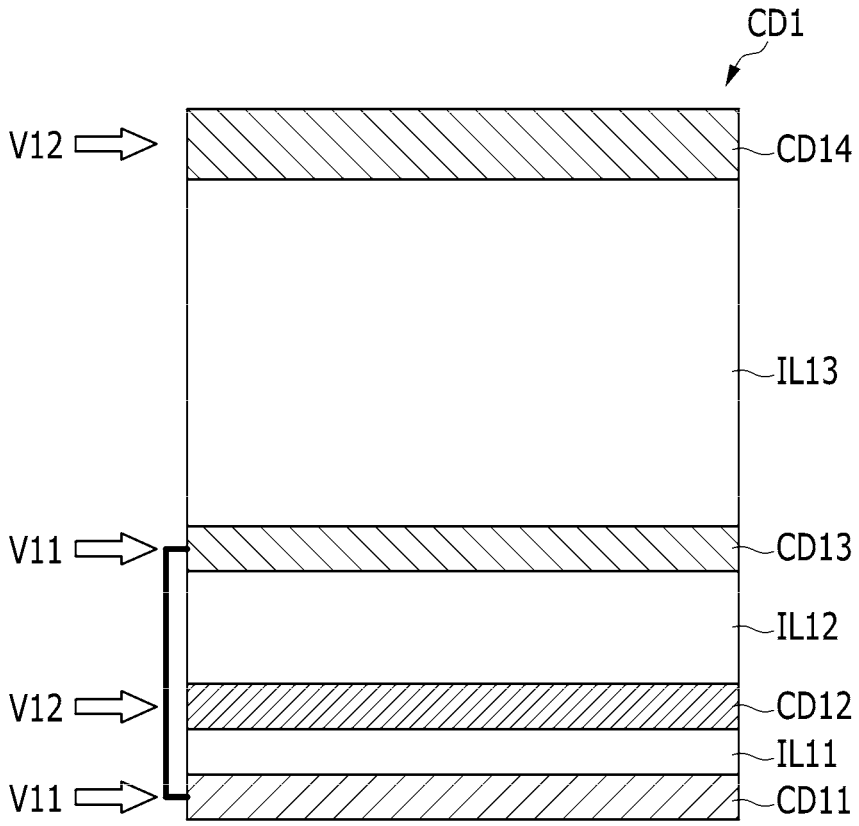
FIG. 5 is a cross-sectional view illustrating a crack detection line in the display panel according to the exemplary embodiment of the present disclosure.

FIG. 5 is a cross-sectional view schematically illustrating the crack detection line according to an exemplary embodiment of the present disclosure.

Referring to FIG. 5, in the display panel 1000 according to an exemplary embodiment of the present disclosure, the crack detection line CD1 includes a first conductive layer CD11, a second conductive layer CD12, a third conductive layer CD13, and a fourth conductive layer CD14 that are stacked on different layers. Further, the crack detection line CD1 includes a plurality of insulating layers IL11, IL12, and IL13, which are each disposed between the first conductive layer CD11 and the second conductive layer CD12, between the second conductive layer CD12 and the third conductive layer CD13, and between the third conductive layer CD13 and the fourth conductive layer CD14.

The first and second conductive layers CD11 and CD12 form a conductive line and are stacked, having the insulating layer IL11 disposed therebetween.

The first conductive layer CD11 and the second conductive layer CD12 are each formed on the same layer as the gate lines (not illustrated), which are each formed on different layers and are made of the same material as the gate electrode of the display panel 1000.

Referring to FIG. 4 as an example, the first conductive layer CD11 is formed on the same layer as the second gate electrode G2 in the pixel circuit 152 and is made of the same material as the second gate electrode G2. Further, the second conductive layer CD12 is formed on the same layer as the first gate electrode G1 in the pixel circuit 152 and is made of the same material as the first gate electrode G1. Further, the insulating layer IL11 provided between the first conductive layer CD11 and the second conductive layer CD12 corresponds to the second insulating layer G12 in the pixel circuit 152 of FIG. 4.

The third conductive layer CD13 is a conductive line and is stacked on the second conductive layer CD12, having the insulating layer IL12 stacked on the second conductive layer CD12 disposed therebetween.

The third conductive layer CD13 is formed on the same layer as the data line (or source/drain electrode) (not illustrated) of the display panel 1000 and is made of the same material as the data line (or source/drain electrode).

Referring to FIG. 4 as an example, the third conductive layer CD13 is formed on the same layer as source/drain electrodes S1 to S6 and D1 to D6 in the pixel circuit 152 and is made of the same material as the source/drain electrodes S1 to S6 and D1 to D6. Further, the insulating layer IL12 provided between the second conductive layer CD12 and the third conductive layer CD13 corresponds to the third insulating layer GI3 or the fourth insulating layer ILD in the circuit 152.

The fourth conductive layer CD14 is a conductive line and is stacked on the third conductive layer CD13, having the insulating layer IL13 stacked on the third conductive layer CD13 disposed therebetween.

The fourth conductive layer CD14 is formed on the same layer as the cathode (not illustrated) of the organic light emitting diode (OLED) and is made of the same material as the cathode.

Referring to FIG. 4 as an example, the fourth conductive layer CD14 is formed on the same layer as the cathode EL2 of the organic light emitting diode (OLED) and is made of the same material as the cathode EL2. Further, the insulating layer IL13 provided between the third conductive layer CD13 and the fourth conductive layer CD14 corresponds to the fifth insulating layer PL or the pixel defined layer PDL.

When the cathode of the organic light emitting diode (OLED) is applied on the entire surface of the upper portion of the display panel 1000, the fourth conductive layer CD14 need not be formed as a separate wiring, and the cathode of the organic light emitting diode (OLED) may be used as the fourth conductive layer CD14.

The first conductive layer CD11 and the third conductive layer CD13 are electrically connected to each other through at least one contact hole (not illustrated).

The first conductive layer CD11 and the third conductive layer CD13 are connected between the first test signal line (see reference numeral DC_G of FIG. 1) and the data line (see reference numeral DA1 of FIG. 1). That is, the first conductive layer CD11 and the third conductive layer CD13 have one end connected to the first test signal line DC_G and the other end connected to the data line DA1. Therefore, a first signal V11 applied through the first test signal line DC_G is transferred to the data line DA1 through the first conductive layer CD11 and the third conductive layer CD13. The first signal V11 is the detection signal V2 of FIG. 2 and is a signal which light-emits the corresponding pixel black.

The first conductive layer CD11 is formed on the same layer as the gate electrode, and is therefore formed on a different layer as the first test signal line DC_G and the data line DA1, which are formed on the same layer as the data line. Therefore, the first conductive layer CD11 may be connected to the first test signal line DC_G and the data line DA1 through at least one contact hole (not illustrated).

The third conductive layer CD13 is formed on the same layer as the data line DA of the display panel 1000 and is therefore formed on the same layer as the first test signal line DC_G and the data line DA1. Therefore, the third conductive layer CD13 may be directly connected to the first test signal line DC_G without a separate connecting member. Further, the third conductive layer CD13 may be formed to intersect the remaining data lines DAs using a contact bridge (not illustrated) which is formed on a layer different from the data line DA so that the remaining data line DA which is not connected to the third conductive layer CD13 is not connected to the third conductive layer CD13.

The second conductive layer CD12 and the fourth conductive layer CD14 are applied with the second signal V12 having a different voltage level from the first signal V11.

The second signal V12 may be a power signal that is applied from the second power supply ELVSS in the pixel circuit 152 of FIG. 4. In this case, the cathode is connected to the second power supply ELVSS, and therefore, when the cathode of the organic light emitting diode (OLED) is used as the fourth conductive layer CD14, there is no need to additionally connect the fourth conductive layer CD14 to the second power supply ELVSS. Further, the second conductive layer CD12 may be connected to the fourth conductive layer CD14 through at least one contact hole (not illustrated).

In the first crack detection line CD1 of the multi-layered wiring structure illustrated in FIG. 5, when the first conductive layer CD11 and the third conductive layer CD13 that are connected to the data line DA1 are damaged by a crack in the peripheral area of the display panel 1000, a resistance of the crack detection line CD1 is increased. Therefore, the voltage (see reference numeral V_T of FIG. 2) applied to the pixel which is connected to the data line DA1 through the crack detection line CD1 is not charged up to the voltage level of the first signal V11. That is, the pixel connected to the data line DA1 does not display a black color, but instead displays brightly.

Further, the insulating layers IL11, IL12, and IL13 are destroyed as a result of the crack in the peripheral area of the display panel 1000 or when foreign particles are present in the insulating layers IL11, IL12, and IL13, and the first or third conductive layer CD11 or CD13 is shorted from the second or fourth conductive layer CD12 or CD14 adjacent thereto. Therefore, the first signal V11 transferred to the data line DA1 may be distorted, and thus, the voltage (see reference numeral V_T of FIG. 2) applied to the pixel is not charged up to the voltage level of the first signal V11. That is, the pixel connected to the data line DA1 does not display a black color, but instead displays brightly.

As described above, when the crack detection line CD1 according to the exemplary embodiment of the present disclosure is applied, even in the case in which the crack detection line CD1 is directly damaged due to a crack in the peripheral area of the display panel 1000, as well as the insulating layer is destroyed or the foreign particles are present, it is possible for the crack detection line CD1 to detect the defect in the display panel 1000.

Figure 6:
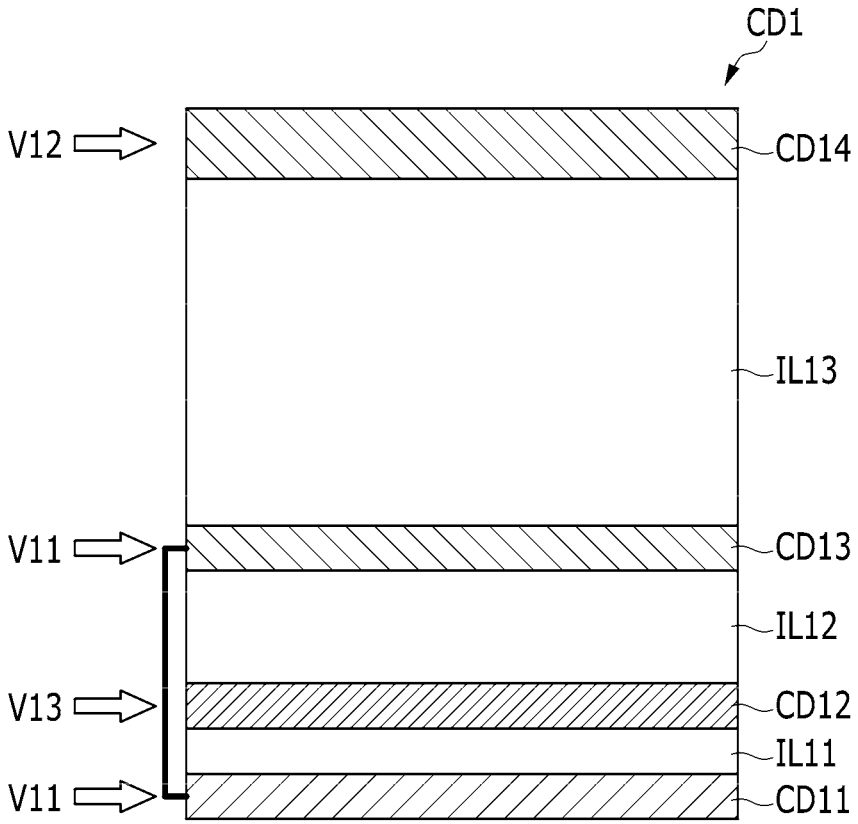
FIG. 6 is a cross-sectional view illustrating a crack detection line in a display panel according to another exemplary embodiment of the present disclosure.

Meanwhile, FIG. 5 illustrates, for example, the case in which the same signal V12 applied to the second conductive layer CD12 and the fourth conductive layer CD14, but exemplary embodiments of the present disclosure are not limited thereto. According to some of the exemplary embodiments of the present disclosure, as illustrated in FIG. 6, the second conductive layer CD12 and the fourth conductive layer CD14 may be applied with different signals V12 and V13. In this case, the fourth conductive layer CD14 is connected to the second power supply ELVSS to be applied with the second signal V12 applied from the second power supply ELVSS. Further, the second conductive layer CD12 is connected to a power pad (not illustrated) to be applied with the third signal V13 from an external power supply through the power pad.

Figure 7:
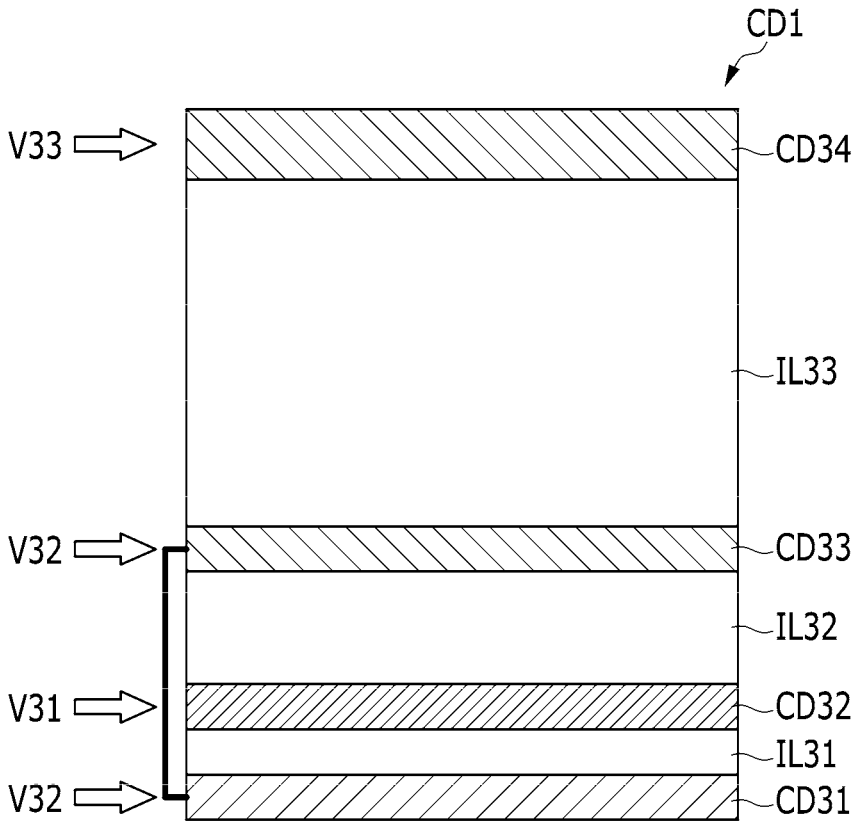
FIG. 7 is a cross-sectional view illustrating a crack detection line in a display panel according to still another exemplary embodiment of the present disclosure.

FIG. 7 is a cross-sectional view schematically illustrating a crack detection line according to another exemplary embodiment of the present disclosure.

Referring to FIG. 7, in the display panel 1000 according to another exemplary embodiment of the present disclosure, the crack detection line CD1 includes a first conductive layer CD31, a second conductive layer CD32, a third conductive layer CD33, and a fourth conductive layer CD34 which are stacked on different layers. Further, the crack detection line CD1 includes a plurality of insulating layers IL31, IL32, and IL33, which are each disposed between the first conductive layer CD31 and the second conductive layer CD32, between the second conductive layer CD32 and the third conductive layer CD33, and between the third conductive layer CD33 and the fourth conductive layer CD34.

Meanwhile, an interlayer stacked structure of the crack detection line CD1 of FIG. 7 is similar to that of the crack detection line according to the exemplary embodiment of the present disclosure illustrated in FIG. 5, and therefore, any redundant description thereof will be omitted below.

The first and second conductive layers CD31 and CD32 form a conductive line and are stacked, having the insulating layer IL31 disposed therebetween.

The first conductive layer CD31 and the second conductive layers CD31 and CD32 are each formed on the same layer as the gate electrodes (not illustrated), which are each formed on different layers in the display panel 1000 and are made of the same material as the gate electrode.

The third conductive layer CD33 is a conductive line and is stacked on the second conductive layer CD32, having the insulating layer IL32 stacked on the second conductive layer CD32 disposed therebetween.

The third conductive layer CD33 is formed on the same layer as the data line (or source/drain electrode) (not illustrated) of the display panel 1000 and is made of the same material as the data line (or source/drain electrode).

The fourth conductive layer CD34 is a conductive line and is stacked on the third conductive layer CD33, having the insulating layer IL33 stacked on the third conductive layer CD13 disposed therebetween.

The fourth conductive layer CD34 is formed on the same layer as the cathode (not illustrated) of the organic light emitting diode (OLED) and is made of the same material as the cathode.

The second conductive layer CD32 is connected between the first test signal line (see reference numeral DC_G of FIG. 1) and the data line (see reference numeral DA1 of FIG. 1). That is, the second conductive layer CD32 has one end connected to the first test signal line DC_G and the other end connected to the data line DA1. Therefore, a first signal V31 applied through the first test signal line DC_G is transferred to the data line DA1 through the second conductive layer CD32. The first signal V31 is the detection signal V2 of FIG. 2 and is a signal which light-emits the corresponding pixel black.

The second conductive layer CD32 is formed on the same layer as the gate electrode, and is therefore formed on a different layer from the first test signal line DC_G and the data line DA1, which are formed on the same layer as the data line. Therefore, the second conductive layer CD32 may be connected to the first test signal line DC_G and the data line DA1 through at least one contact hole (not illustrated).

The first conductive layer CD31 and the third conductive layer CD33, which are formed on different layers, are electrically connected to each other through at least one contact hole (not illustrated). The first conductive layer CD31 and the third conductive layer CD33 are applied with the second signal V32 having a different voltage level from the first signal V31.

The second signal V32 may be a power signal which is applied from the second power supply ELVSS in the pixel circuit 152 of FIG. 4. In this case, the first conductive layer CD31 and the third conductive layer CD33 are connected to the second power supply ELVSS through at least one contact hole (not illustrated) to be applied with the second signal V32 from the second power supply ELVSS.

An external power supply may supply the second signal V32 as a power signal. In this case, the first conductive layer CD31 and the third conductive layer CD33 are connected to the power pad (not illustrated) and receive the second signal V32 applied from the external power supply through the power pad.

The fourth conductive layer CD34 is applied with the third signal V33.

The third signal V33 may be the same signal as the first signal V31. In this case, the fourth conductive layer CD34 is connected to the second conductive layer CD32 through at least one contact hole (not illustrated) to receive the first signal V31 applied through the first test signal line DC_G.

The third signal V33 may also be a power signal which is supplied from the second power supply ELVSS in the pixel circuit 152 of FIG. 4. In this case, the cathode is connected to the second power supply ELVSS, and therefore, when the cathode of the organic light emitting diode (OLED) is used as the fourth conductive layer CD34, there is no need to additionally connect the fourth conductive layer CD34 to the second power supply ELVSS.

The third signal V33 may be a power signal applied from an external power supply. In this case, the third conductive layer CD33 is connected to the power pad (not illustrated) through at least one contact hole and receives the third signal V33 applied from the external power supply through the power pad.

In the first crack detection line CD1 of the multi-layered wiring structure illustrated in FIG. 7, when the second conductive layer CD32, which is connected to the data line DA1, is damaged by the crack in the peripheral area of the display panel 1000, the resistance of the crack detection line CD1 is increased. Therefore, the voltage (see reference numeral V_T of FIG. 2) applied to the pixel which is connected to the data line DA1 is not charged up to the voltage level of the first signal V31. That is, the pixel connected to the data line DA1 does not display a black color but instead displays brightly.

Further, the insulating layers IL31, IL32, and IL33 are destroyed as a result of the crack in the peripheral area of the display panel 1000 or when the foreign particles are present in the insulating layers IL31, IL32, and IL33, and the second conductive layer CD32 is shorted from the first or third conductive layer CD31 or CD33 adjacent thereto. Therefore, the first signal V31 transferred to the data line DA1 through the second conductive layer CD32 may be distorted, and thus, the voltage (see reference numeral V_T of FIG. 2) applied to the pixel is not charged up to the voltage level of the first signal V31. That is, the pixel connected to the data line DA1 does not display a black color, but instead displays brightly.

As described above, when the crack detection line CD1 having the structure illustrated in FIG. 7 is applied, even in the case in which the crack detection line CD1 is directly damaged due to the crack in the peripheral area of the display panel 1000 as well as the insulating layer is destroyed or the foreign particles are present, it is possible for the crack detection line CD1 to detect of the defect in the display panel 1000.

Figure 8:
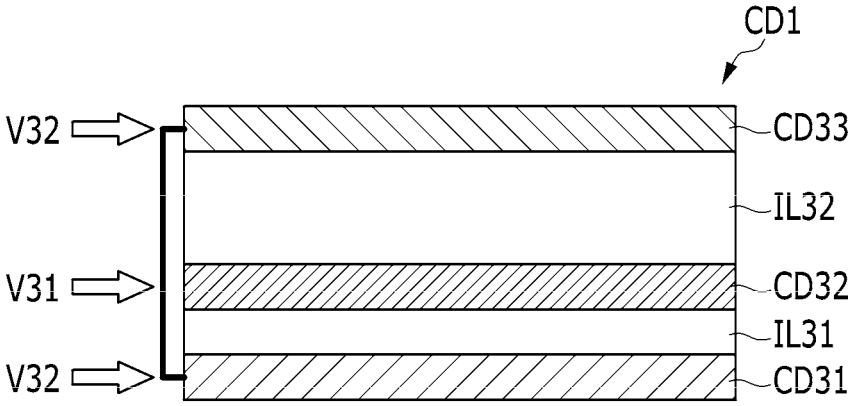
FIG. 8 is a cross-sectional view illustrating a crack detection line in a display panel according to still another exemplary embodiment of the present disclosure.

Meanwhile, FIG. 7 illustrates, for example, the case in which the crack detection line CD1 is the multi-layered wiring structure in which the four conductive layers and the three insulating layers are stacked, but the exemplary embodiment of the present disclosure is not limited thereto. According to some of the exemplary embodiments of the present disclosure, as illustrated in FIG. 8, the crack detection line CD1 may be the multi-layered wiring structure in which the three conductive layers CD31, CD32, and CD33 and the two insulating layers IL31 and IL32 are stacked.

Figure 9:
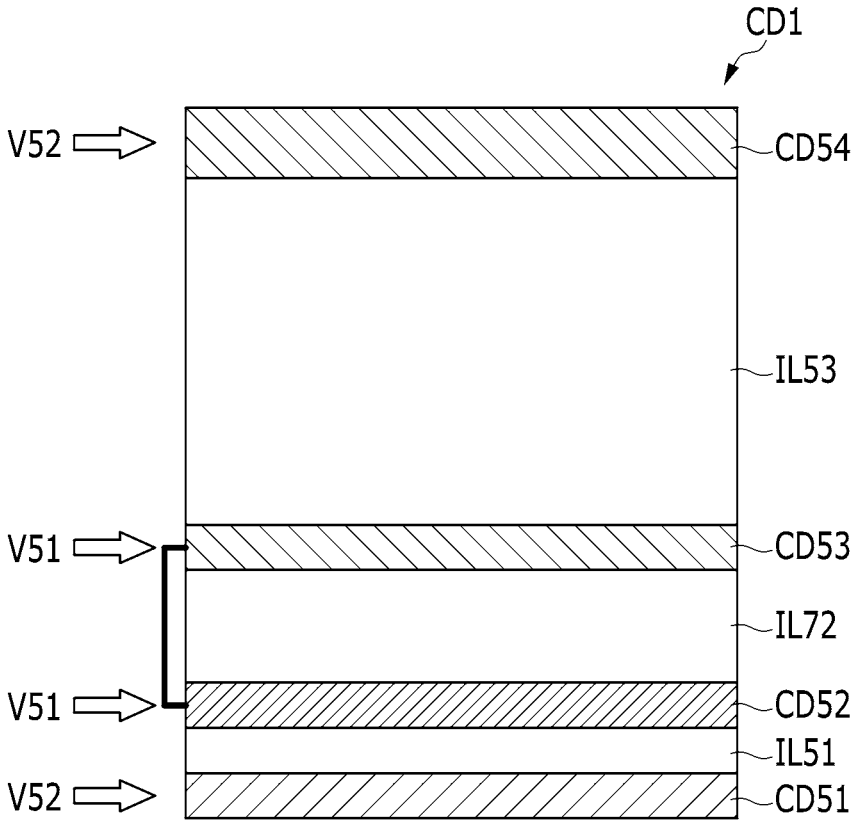
FIG. 9 is a cross-sectional view illustrating a crack detection line in a display panel according to still another exemplary embodiment of the present disclosure.

FIG. 9 is a cross-sectional view schematically illustrating a crack detection line according to another exemplary embodiment of the present disclosure.

Referring to FIG. 9, in the display panel 1000 according to another exemplary embodiment of the present disclosure, the crack detection line CD1 includes a first conductive layer CD51, a second conductive layer CD52, a third conductive layer CD53, and a fourth conductive layer CD54, which are stacked on different layers. The crack detection line CD1 includes a plurality of insulating layers IL51, IL52, and IL53, which are each disposed between the first conductive layer CD51 and the second conductive layer CD52, between the second conductive layer CD52 and the third conductive layer CD53, and between the third conductive layer CD53 and the fourth conductive layer CD54.

Meanwhile, an interlayer stacked structure of the crack detection line CD1 of FIG. 9 is similar to that of the crack detection line according to the exemplary embodiment of the present disclosure illustrated in FIG. 5, and therefore any redundant description thereof will be omitted below.

The first and second conductive layers CD51 and CD52 are a conductive line and are stacked, having the insulating layer IL51 disposed therebetween.

The first conductive layer CD51 and the second conductive layer CD52 are each formed on the same layer as the gate electrodes (not illustrated) which are formed on different layers in the display panel 1000 and are made of the same material as the gate electrode.

The third conductive layer CD53 is a conductive line and is stacked on the second conductive layer CD52, having the insulating layer IL52 stacked on the second conductive layer CD52 disposed therebetween.

The third conductive layer CD53 is formed on the same layer as the data line (or source/drain electrode) (not illustrated) and is made of the same material as the data line (or source/drain electrode).

The fourth conductive layer CD54 is a conductive line and is stacked on the third conductive layer CD53, having the insulating layer IL53 stacked on the third conductive layer CD53 disposed therebetween.

The fourth conductive layer CD54 is formed on the same layer as the cathode (not illustrated) of the organic light emitting diode (OLED), and is made of the same material as the cathode. When the cathode of the organic light emitting diode (OLED) is applied over the entire surface of the upper portion of the display panel 1000, the fourth conductive layer CD54 may not be formed as a separate wiring, and the cathode of the organic light emitting diode (OLED) may be used as the fourth conductive layer CD54.

The second conductive layer CD52 and the third conductive layer CD53, which are formed on different layers, are electrically connected to each other through the contact hole (not illustrated).

The second conductive layer CD52 and the third conductive layer CD53 are connected between the first test signal line (see reference numeral DC_G of FIG. 1) and the data line (see reference numeral DA1 of FIG. 1). That is, the second conductive layer CD52 and the third conductive layer CD53 have one end connected to the first test signal line DC_G and the other end connected to the data line DA1. Therefore, a first signal V51 applied through the first test signal line DC_G is transferred to the data line DA1 through the second conductive layer CD52 and the third conductive layer CD53. The first signal V51 is the detection signal V2 of FIG. 2 and is a signal which light-emits the corresponding pixel black.

The second conductive layer CD52 is formed on the same layer as the gate electrode, and therefore, is formed on a different layer from the first test signal line DC_G and the data line DA1, which are formed on the same layer as the data line. Therefore, the second conductive layer CD52 may be connected between the first test signal line DC_G and the data line DA1 through at least one contact hole (not illustrated).

The third conductive layer CD53 is formed on the same layer as the test signal line DC_G and the data line DA1. Therefore, the third conductive layer CD53 may be directly connected to the first test signal line DC_G without a separate connecting member. Further, the third conductive layer CD53 may be formed to intersect the data lines DAs using a contact bridge (not illustrated), which is formed on a layer different from the data line DA so that the remaining data line DA which is not connected to the third conductive layer CD53 is not connected to the third conductive layer CD53.

The first conductive layer CD51 and the fourth conductive layer CD54 are applied with the second signal V52 having a different voltage level from the first signal V51.

The second signal V51 may be a power signal applied from an external power supply. In this case, the first conductive layer CD51 and the fourth conductive layer CD54 are connected to the power pad (not illustrated) and receive second signal V52 applied from the external power supply through the power pad.

The second signal V52 may also be a power signal which is supplied from the second power supply ELVSS in the pixel circuit 152 of FIG. 4. In this case, the cathode is connected to the second power supply ELVSS, and therefore, when the cathode of the organic light emitting diode (OLED) is used as the fourth conductive layer CD54, there is no need to additionally connect the fourth conductive layer CD54 to the second power supply ELVSS. Further, the first conductive layer CD51 is connected to the fourth conductive layer CD54 through the contact hole (not illustrated) to receive the second signal V52 from the second power supply ELVSS.

In the first crack detection line CD1 of the multi-layered wiring structure illustrated in FIG. 9, when the second conductive layer CD52 and the third conductive layer CD53 which are connected to the data line DA1 are damaged by the crack in the peripheral area of the display panel 1000, a resistance of the crack detection line CD1 is increased. Therefore, the voltage (see reference numeral V_T of FIG. 2) applied to the pixel which is connected to the data line DA1 through the crack detection line CD1 is not charged up to the voltage level of the first signal V51. That is, the pixel connected to the data line DA1 does not display a black color but instead displays brightly.

Further, the insulating layers IL51, IL52, and IL53 are destroyed due to the crack in the peripheral area of the display panel 1000 or when the foreign particles are present in the insulating layers IL51, IL52, and IL53, and the second conductive layer CD52 or the third conductive layer CD53 is shorted from the first or fourth conductive layer CD51 or CD54 adjacent thereto. Therefore, the first signal V51 transferred to the data line DA1 may be distorted, and thus, the voltage (see reference numeral V_T of FIG. 2) applied to the pixel is not charged up to the voltage level of the first signal V51. That is, the pixel connected to the data line DA1 does not display a black color, but instead displays brightly.

Figure 10:
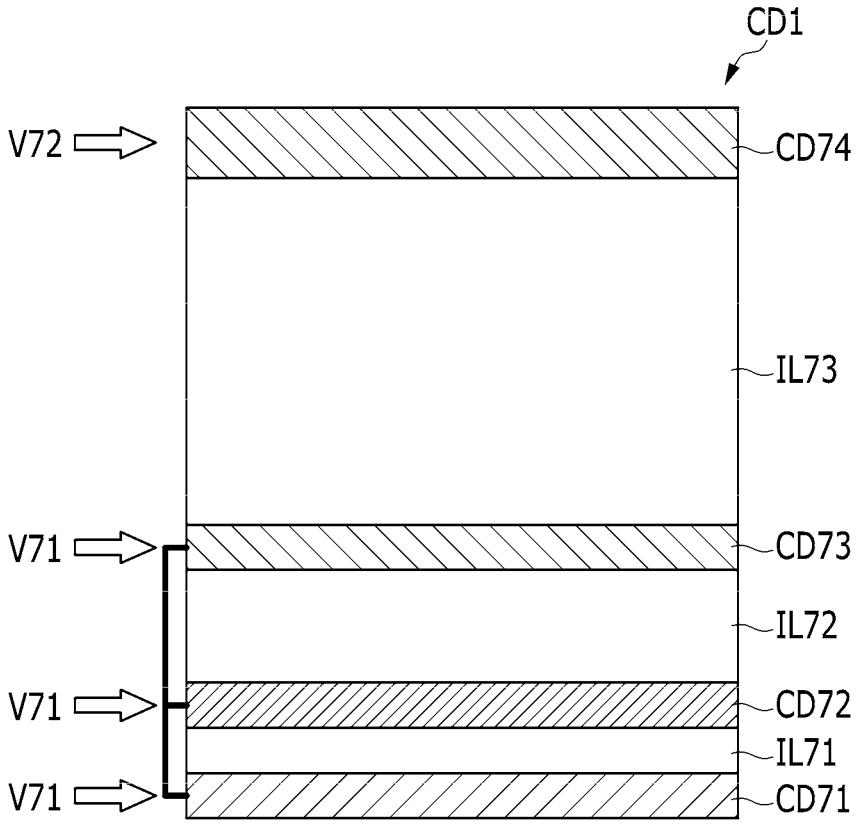
FIG. 10 is a cross-sectional view illustrating a crack detection line in a display panel according to still another exemplary embodiment of the present disclosure.

FIG. 10 is a cross-sectional view schematically illustrating a crack detection line according to another exemplary embodiment of the present disclosure.

Referring to FIG. 10, in the display panel 1000 according to another exemplary embodiment of the present disclosure, the crack detection line CD1 includes a first conductive layer CD71, a second conductive layer CD72, a third conductive layer CD73, and a fourth conductive layer CD74 which are stacked on different layers. Further, the crack detection line CD1 includes a plurality of insulating layers IL71, IL72, and IL73 which are each disposed between the first conductive layer CD71 and the second conductive layer CD72, between the second conductive layer CD72 and the third conductive layer CD73, and between the third conductive layer CD73 and the fourth conductive layer CD74.

Meanwhile, an interlayer stacked structure of the crack detection line CD1 of FIG. 10 is similar to that of the crack detection line according to the exemplary embodiment of the present disclosure illustrated in FIG. 5, and therefore any redundant description thereof will be omitted below.

The first and second conductive layers CD71 and CD72 are a conductive line and are stacked, having the insulating layer IL71 disposed therebetween.

The first conductive layer CD71 and the second conductive layer CD72 are each formed on the same layer as the gate electrodes (not illustrated), which are formed on different layers and are made of the same material as the gate electrode.

The third conductive layer CD73 is a conductive line and is stacked on the second conductive layer CD72, having the insulating layer IL72 stacked on the second conductive layer CD72 disposed therebetween.

The third conductive layer CD73 is formed on the same layer as the data line (or source/drain electrode) (not illustrated) and is made of the same material as the data line (or source/drain electrode).

The fourth conductive layer CD74 is a conductive line and is stacked on the third conductive layer CD73, having the insulating layer IL73 stacked on the third conductive layer CD73 disposed therebetween.

The fourth conductive layer CD74 is formed on the same layer as the cathode (not illustrated) of the organic light emitting diode (OLED), and is made of the same material as the cathode. When the cathode of the organic light emitting diode (OLED) is applied over the entire surface of the upper portion of the display panel 1000, the fourth conductive layer CD74 may not be formed as a separate wiring and the cathode of the organic light emitting diode (OLED) may be used as the fourth conductive layer CD74.

The first, second, and third conductive layers CD71, CD72, and CD73 which are formed on different layers are electrically connected to one another through at least one contact hole (not illustrated). The first conductive layer CD71, the second conductive layer CD72, and the third conductive layer CD73 are connected between the first test signal line (see reference numeral DC_G of FIG. 1) and the data line (see reference numeral DA1 of FIG. 2). That is, the first, second, and third conductive layers CD71, CD72, and CD73 have one end connected to the first test signal line DC_G and the other end connected to the data line DA1. Therefore, a first signal V71 applied through the first test signal line DC_G is transferred to the data line DA1 through the first, second, and third conductive layers CD71, CD72, and CD73. The first signal V71 is the detection signal V2 of FIG. 2 and is a signal which light-emits the corresponding pixel black.

The first and second conductive layers CD72 are formed on the same layer as the gate electrode, and are therefore formed on a different layer from the first test signal line DC_G and the data line DA1, which are formed on the same layer as the data line. Therefore, the first and second conductive layers CD72 may be connected between the first test signal line DC_G and the data line DA1 through at least one contact hole (not illustrated).

The third conductive layer CD73 is formed on the same layer as the test signal line DC_G and the data line DA1. Therefore, the third conductive layer CD73 may be directly connected to the first test signal line DC_G without a separate connecting member. Further, the third conductive layer CD73 may be formed to intersect the data lines DAs using a contact bridge (not illustrated) which is formed on a layer different from the data line DA so that the remaining data line DA which is not connected to the third conductive layer CD73 is not connected to the third conductive layer CD73.

The fourth conductive layer CD74 is applied with the second signal V72 having a different voltage level from the first signal V71.

The second signal V72 may be a power signal supplied from an external power supply. In this case, the fourth conductive layer CD74 is connected to the power pad (not illustrated) and receives the second signal V72 applied from the external power supply through the power pad.

The second signal V72 may be a power signal which is supplied from the second power supply ELVSS in the pixel circuit 152 of FIG. 4. In this case, the cathode is connected to the second power supply ELVSS, and therefore when the cathode of the organic light emitting diode (OLED) is used as the fourth conductive layer CD74, there is no need to additionally connect the fourth conductive layer CD74 to the second power supply ELVSS.

In the crack detection line CD1 having the multi-layered wiring structure illustrated in FIG. 10, when the first, second, and third conductive layers CD71, CD72, and CD73, which are connected to the data line DA1, are damaged by the crack in the peripheral area of the display panel 1000, the resistance of the crack detection line CD1 is increased.

Therefore, the voltage (see reference numeral V_T of FIG. 2) applied to the pixel which is connected to the data line DA1 is not charged up to the voltage level of the first signal V71. That is, the pixel connected to the data line DA1 does not display a black color, but instead displays brightly.

Further, as the insulating layer IL73 between the third conductive layer CD73 and the fourth conductive layer CD74 is destroyed as a result of the crack in the peripheral area of the display panel 1000 or includes foreign particles, when the third insulating layer CD73 is shorted from the fourth conductive layer CD74, the first signal V71 transferred to the data line DA1 is distorted by the second signal V72.

Therefore, the voltage (see reference numeral V_T of FIG. 2) applied to the pixel is not charged up to the voltage level of the first signal V71. That is, the pixel connected to the data line DA1 does not display a black color, but instead displays brightly.

According to an exemplary embodiment of the present disclosure, it is possible to detect damage of the display panel occurring resulting from the case in which the crack detection line is directly damaged due to the occurrence of crack in the peripheral area of the display panel, the destruction of the insulating layer, or the presence of foreign particles between the layers.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display panel, comprising:

pixels disposed in an active area of a substrate;

data lines connected to the pixels; and a crack detection line disposed in a peripheral area of the active area in the substrate, wherein:

the crack detection line comprises at least three stacked conductive layers and at least two insulating layers, each of the insulating layers being disposed between two of the conductive layers so as to be separated from each other along an entire length of the crack detection line; and at least one of the conductive layers is configured to be electrically connected to any one of the data lines and to receive a first signal during a crack detection test, and another one of the conductive layers is configured to receive a second signal having a different voltage level from the first signal.

2. The display panel of claim 1, wherein:

the crack detection line comprises a first conductive layer, a second conductive layer stacked on the first conductive layer, a first insulating layer disposed therebetween, a third conductive layer stacked on the second conductive layer, and a second insulating layer disposed therebetween;

the first and second conductive layers are formed on the same layers as gate electrodes that are formed on different layers in a pixel circuit of the active area; and the third conductive layer is formed on the same layer as source/drain electrodes in the pixel circuit.

3. The display panel of claim 2, wherein the first and third conductive layers are connected to each other through at least one contact hole.

4. The display panel of claim 3, wherein the first and third conductive layers are electrically connected to any one data line.

5. The display panel of claim 3, wherein the second conductive layer is electrically connected to any one data line.

6. The display panel of claim 2, wherein the second conductive layer and the third conductive layer are electrically connected to each other through a contact hole.

7. The display panel of claim 6, wherein the second and third conductive layers are electrically connected to any one data line.

8. The display panel of claim 2, wherein the first, second, and third conductive layers are connected to one another through a plurality of contact holes.

9. The display panel of claim 8, wherein the first, second, and third conductive layers are electrically connected to any one data line.

10. The display panel of claim 1, wherein the at least one conductive layer is electrically connected to any one data line through a switching element.

* * * * *